US006513948B1

(12) United States Patent
Noh

(10) Patent No.: US 6,513,948 B1
(45) Date of Patent: Feb. 4, 2003

(54) U-SHAPED FLUORESCENT LAMP

(75) Inventor: Shi Youl Noh, Seoul (KR)

(73) Assignee: Feelux Co., Ltd., Kyonggi-do (KR)

( * ) Notice: Subject to any disclaimer, the term of this patent is extended or adjusted under 35 U.S.C. 154(b) by 0 days.

(21) Appl. No.: 09/906,775

(22) Filed: Jul. 18, 2001

(51) Int. Cl.[7] ..... F21K 27/00
(52) U.S. Cl. ..... 362/216; 362/260; 362/225
(58) Field of Search ..... 362/260, 216, 362/225; 313/318.09, 318.12, 634

(56) References Cited

U.S. PATENT DOCUMENTS 6,116,754 A * 9/2000 Ocsovai et al. ..... 362/216

FOREIGN PATENT DOCUMENTS

EP 10983350 * 9/2001

* cited by examiner

*Primary Examiner*—Thomas M. Sember
(74) *Attorney, Agent, or Firm*—Greenblum & Bernstein, P.L.C.

(57) ABSTRACT

A U-shaped fluorescent lamp for use in existing lighting fittings includes a PCB (Printed Circuit Board) located in a central portion between fluorescent tubes. This arrangement reduces the length of the U-shaped fluorescent lamp. The U-shaped fluorescent lamp includes a socket, a casing, a PCB and a plurality of U-shaped fluorescent tubes. The PCB is located in the central portion surrounded by the plurality of U-shaped fluorescent tubes.

2 Claims, 4 Drawing Sheets

U-SHAPED FLUORESCENT LAMP

BACKGROUND OF THE INVENTION

1. Field of the Invention

The present invention relates to a U-shaped fluorescent lamp, and more particularly, to a U-shaped fluorescent lamp which is applicable to existing lighting fittings by disposing a PCB(Printed Circuit Board), which comprised in the U-shaped fluorescent lamp, on a central space between fluorescent tubes, so as to reduce the overall length of the fluorescent lamp.

2. Background of the Related Art

In general, U-shaped fluorescent lamps are most widely used as illuminating apparatuses in homes and offices, substituting for existing incandescent lamps. The fluorescent lamps serve to achieve energy saving and improve brightness by employing a three wavelength material for the fluorescent lamps, and protect eyesight by realizing a near natural light, as well as extending a life, thereby solving a short life which is a problem of the existing incandescent lamps. The current trend is directed to developing various technologies to satisfy all given conditions of the incandescent lamps.

The above explained U-shaped fluorescent lamps are designed to be adaptable to sockets which are used for the existing incandescent lamps.

The conventional U-shaped fluorescent lamp 10 includes, as shown in FIG. 1 and FIG. 2, a socket 2 having a protrusion part, a PCB(Printed Circuit Board) being accommodated within a casing which is connected to the socket 2, and U-shaped fluorescent tubes 8 being electrically connected to the PCB to emit light. The conventional U-shaped fluorescent lamp 10 constructed as above is used by connecting the socket 2 to a socket coupling part 14 of a lighting fitting, such as a lamp shade 12, in homes or offices.

In order to accommodate the PCB 6 within the casing 4, there is needed a certain size of space. Therefore, the overall length of the U-shaped fluorescent lamp is inevitably longer than that of the conventional incandescent lamp. In the event that the U-shaped fluorescent lamp 10 is applied to an existing lighting fitting which is designed to exhibit conformity to size of the incandescent lamp, end parts of the fluorescent tubes 8 are exposed to the outside of the lamp shade 12 as far as approximately t ranging from 45 to 55 m/m, thereby marring the beauty of the outward appearance.

Many attempts have been made to obviate the above problems. Still, the U-shaped fluorescent lamp 10 which has to maintain a predetermined length for the brightness or illumination, has a limit in reducing the length of the fluorescent tubes 8. Moreover, it is actually difficult to reduce the length of the fluorescent tubes 8 under a current condition that a standard with respect to the size of the U-shaped fluorescent lamp has nearly been fixed.

For all that, to replace all the lighting fittings is an impracticable idea, requiring too much expense.

SUMMARY OF THE INVENTION

Accordingly, the present invention is directed to a [U-shaped fluorescent lamp] that substantially obviates one or more problems due to limitations and disadvantages of the related art.

An object of the present invention is to provide a U-shaped fluorescent lamp, which achieve an excellent aesthetic effect by developing strong points of conventional U-shaped fluorescent lamps and changing an outward appearance to be adaptable to existing lighting fittings.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a U-shaped fluorescent lamp includes a socket; a PCB(Printed Circuit Board) on which a stabilizer and so on are installed; a plurality of U-shaped fluorescent tubes; and a reflecting plate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 3:
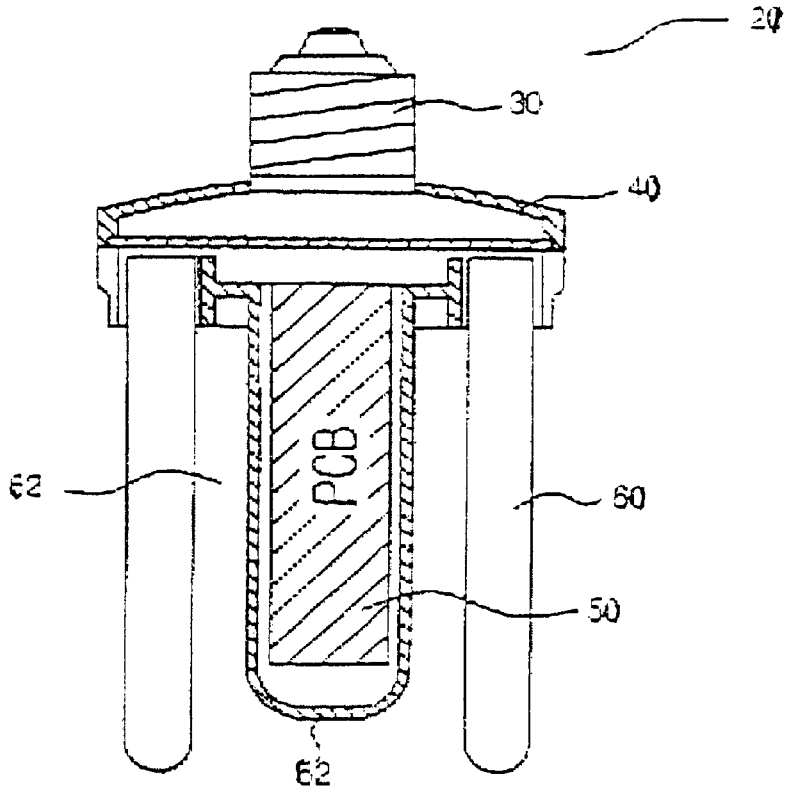
FIG. 3 illustrates a sectional view of a construction of a U-shaped fluorescent lamp according to the present invention.
Figure 4:
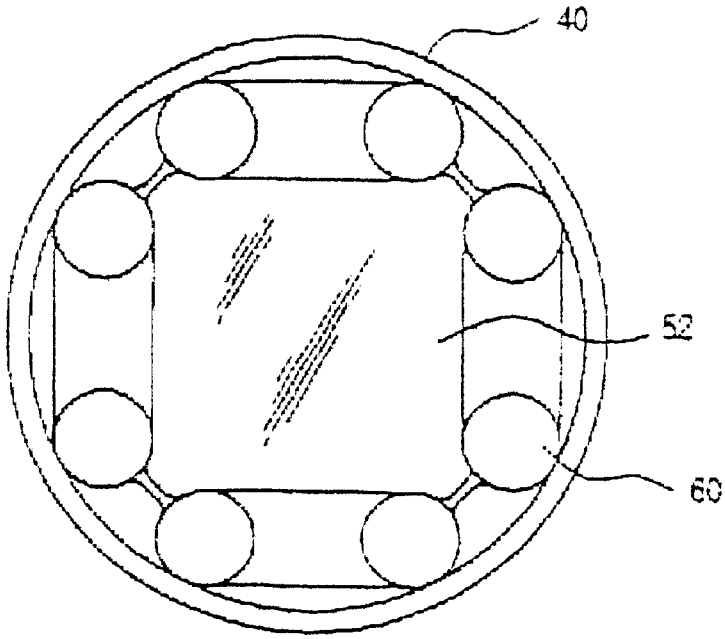
FIG. 4 illustrates a plan view of the U-shaped fluorescent lamp according to the present invention.

FIG. 3 illustrates a sectional view of a construction of a U-shaped fluorescent lamp according to the present invention. FIG. 4 illustrates a plan view of the U-shaped fluorescent lamp according to the present invention.

Referring to FIG. 3 and FIG. 4, the U-shaped fluorescent lamp according to the present invention is comprised of a socket 30 having a protrusion part; a PCB(Printed Circuit Board) 50 being installed on a central part of a casing 40 which is connected to the socket 30; and a plurality of U-shaped fluorescent tubes 60 surrounding the PCB 50.

The socket 30 applies an electric power by being coupled to a socket coupling part of a lighting fitting. The fluorescent tubes 60 are simply installable as a four or more-piece set. Colors of the fluorescent tubes 60 are also variously changeable according to the atmosphere.

A reflecting plate 52 is installed along an outer peripheral surface of the PCB 50, such that the maximal brightness is ensured, a stylish visual effect is achieved, and the PCB is protected from an external impact.

Figure 1:
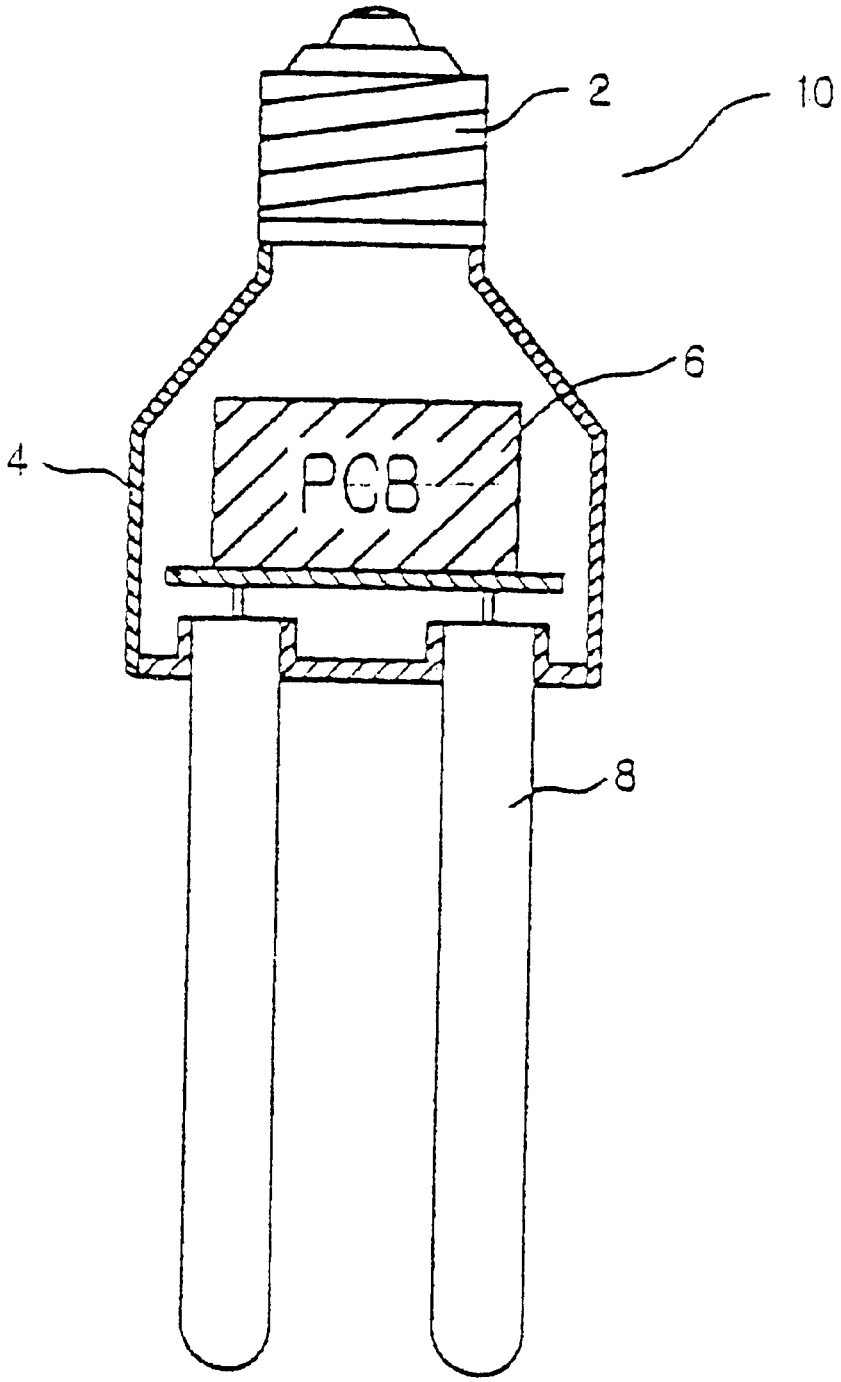
Fig. 1 Prior Art
FIG. 1 illustrates a sectional view of a construction of a conventional U-shaped fluorescent lamp.
Figure 2:
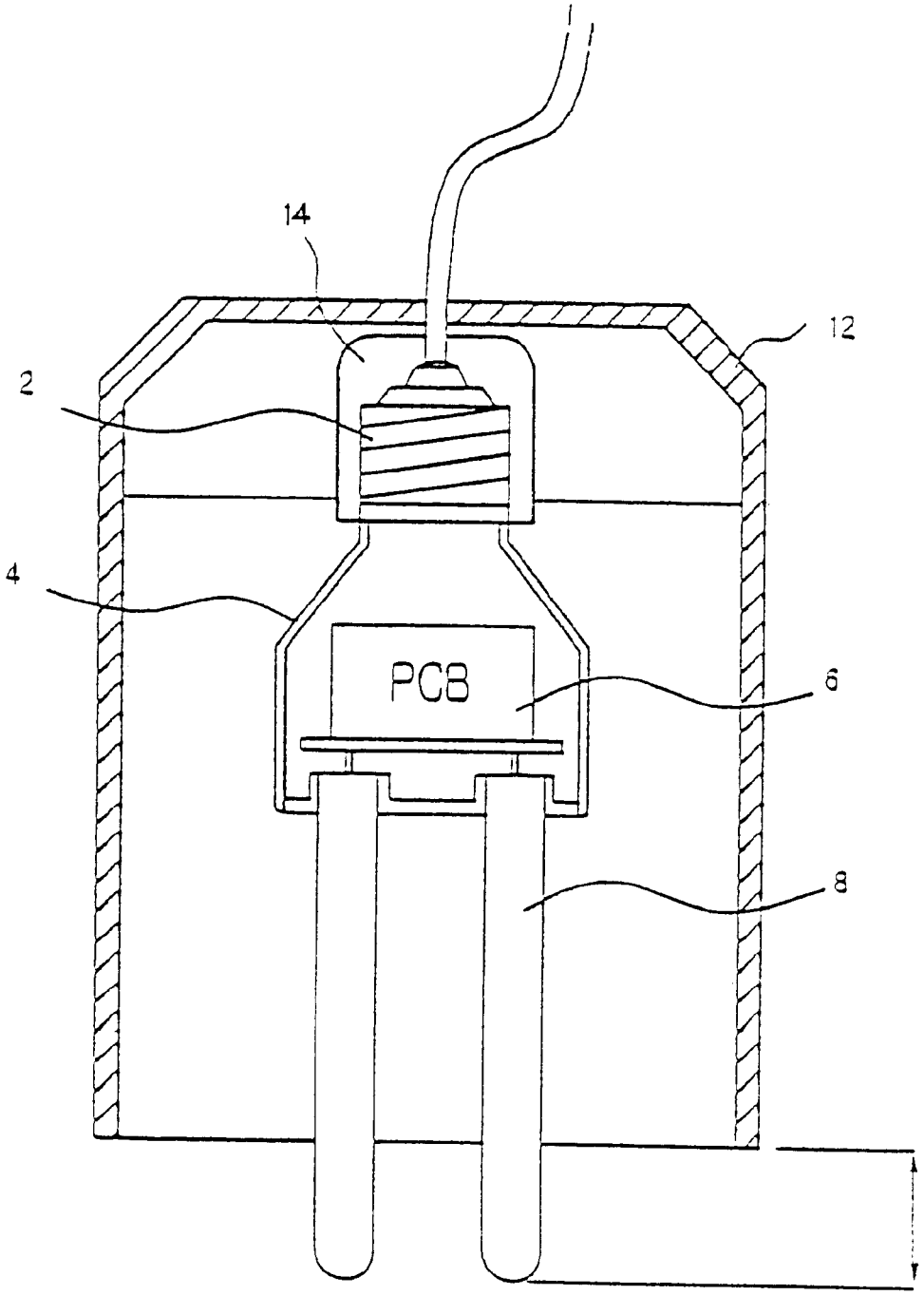
Fig. 2 Prior Art
FIG. 2 illustrates a state where the conventional U-shaped fluorescent lamp is installed on a lighting fitting.

Since the PCB 50 is installed on a central space part 62 which is surrounded by the plurality of U-shaped fluorescent tubes 60, the total length is reduced by a length as long as a space part inside the casing, the space part being occupied by the existing PCB 6 as shown in FIG. 1.

Further, a desired natural light may be realized by properly combining the plurality of fluorescent tubes 60 of different color temperatures. That is to say, the respective fluorescent tubes 60 have different kelvin temperatures, so that color rendering is enhanced, eyesight protection is achieved, and an illumination level of high sensibility which we have not experienced is realized.

The color rendering allows a user to feel a near natural light by combining colors with different kelvin temperatures.

Figure 5:
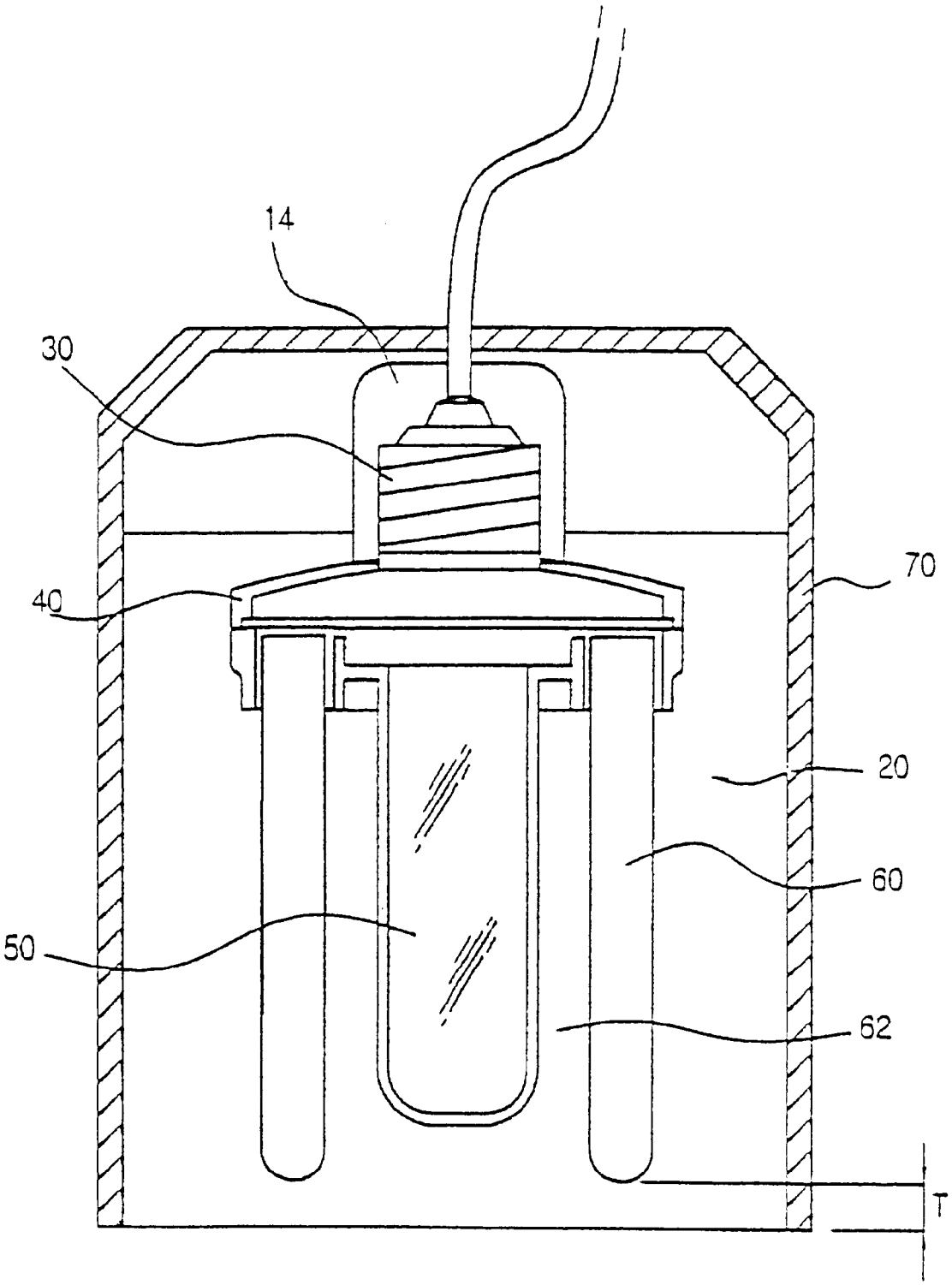
FIG. 5 illustrates a state where the U-shaped fluorescent lamp is installed on a lighting fitting according to the present invention.

FIG. 5 illustrates a state that the U-shaped fluorescent lamp is installed on the lighting fitting. The socket coupling part has the same reference numeral as that in the conventional art, for convenience in explanation.

The aforesaid fluorescent lamp 20 is used by being installed on the lighting fitting, such as the lamp shade 70, etc., in homes and offices. In brief explanation of a method for installing the fluorescent lamp 60 on the lamp shade 70, the method is carried out by connecting the socket 30 of the fluorescent lamp 20 to the socket coupling part 14 of the lamp shade 70.

In the U-shaped fluorescent lamp 20, the PCB 50 is disposed on the central space part 62 between the U-shaped fluorescent tubes 60, thereby removing a need of securing the space inside the casing 40. In consequence, the total length of the U-shaped fluorescent lamp 60 becomes the same as the existing incandescent lamps. Even if the U-shaped fluorescent lamp is installed on the socket coupling part 14 of the existing lighting fitting, the U-shaped fluorescent tubes 60 are not exposed to the outside of the lamp shade 70.

Rather, there is generated a clearance of T, approximately 10 m/m, whereby the U-shaped fluorescent lamp does not give rise to any problem in opening and closing a cover, if any.

As stated above, the present invention has advantages of reducing cost and improving the beauty of the outward appearance, since the overall length of the fluorescent lamp is decreased, and the existing lighting fitting is usable without being replaced, by disposing the PCB on the central space part between the fluorescent tubes.

The present invention has yet another advantage of relieving eye strain and protecting eyesight, since the near natural light can be attained.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A U-shaped fluorescent lamp comprising:

a socket;

a casing including a first end connected to said socket;

a PCB(Printed Circuit Board) extending from a second end of said casing away from said socket; and a plurality of U-shaped fluorescent tubes extending from said second end of said casing away from said socket, wherein substantially an entire length of said PCB extends longitudinally within a central space circumferentially surrounded by said plurality of U-shaped fluorescent tubes.

2. The lamp of claim 1, wherein a reflecting plate is mounted between an outer peripheral surface of said PCB and said plurality of U-shaped fluorescent tubes.

* * * * *